US008194870B2

(12) United States Patent
Saltykov et al.

(10) Patent No.: US 8,194,870 B2
(45) Date of Patent: Jun. 5, 2012

(54) TEST COUPLER FOR HEARING INSTRUMENTS EMPLOYING OPEN-FIT EAR CANAL TIPS

(75) Inventors: Oleg Saltykov, Fairlawn, NJ (US); Anton Gebert, Kleinsendelbach (DE); Ottmar Ruschig, Forchheim (DE); Marco Lederer, Hirschaid/Erlach (DE)

(73) Assignees: Siemens Hearing Instruments, Inc., Piscataway, NJ (US); Siemens Audiologische Technik GmbH, Erlangen (DE)

( * ) Notice: Subject to any disclaimer, the term of this patent is extended or adjusted under 35 U.S.C. 154(b) by 820 days.

(21) Appl. No.: 12/329,692

(22) Filed: Dec. 8, 2008

(65) Prior Publication Data

US 2010/0092001 A1 Apr. 15, 2010

Related U.S. Application Data

(60) Provisional application No. 61/105,496, filed on Oct. 15, 2008.

(51) Int. Cl.
*H04R 29/00* (2006.01)

(52) U.S. Cl. ..... 381/60

(58) Field of Classification Search ..... 381/60
See application file for complete search history.

(56) References Cited

U.S. PATENT DOCUMENTS

2009/0316921 A1* 12/2009 Lloyd et al. ..... 381/60

OTHER PUBLICATIONS

American National Standard—ANSI S3.22.2003—Specification of Hearing Aid Characteristics—2003.
Final Draft International Standard Projet Final De Norme Internationale—Aug. 8, 2002—Copyright 2005—CEI Aug. 8, 2002.
Product Data—Ear Simulator—Type 4157—Jan. 2008.

* cited by examiner

*Primary Examiner* — Benjamin Sandvik
*Assistant Examiner* — Whitney T Moore
(74) *Attorney, Agent, or Firm* — Francis G Montgomery

(57) ABSTRACT

In a system and method for open fitting hearing aid frequency response sound measurements, a test space is provided having located therein a sound source, a hearing aid with a microphone, and an open fit receiver. An acoustic shield is provided and within the acoustic shield an ear simulator coupler is provided having an ear extension attached thereto, the ear extension having mounted thereto at least a portion of the open fit receiver. A measurement unit receives sound signals from the ear simulator coupler.

7 Claims, 4 Drawing Sheets

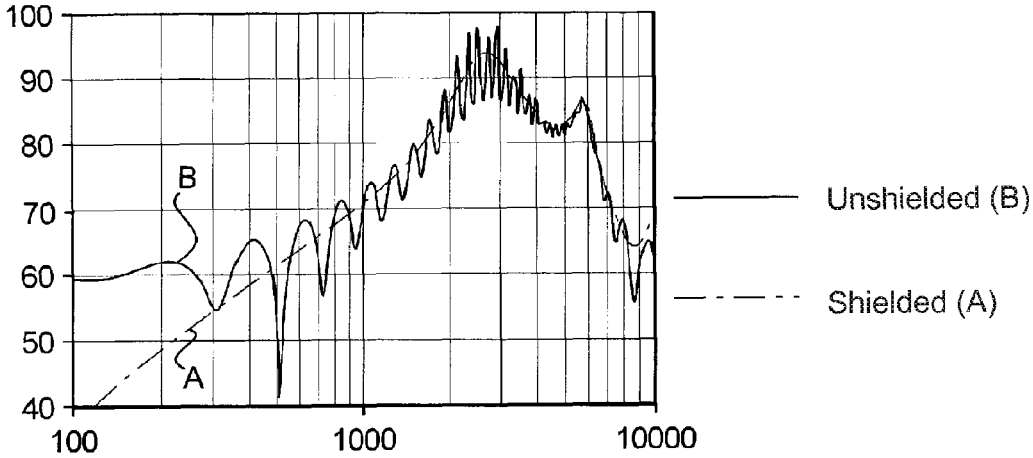
FIG. 6
FIG. 7
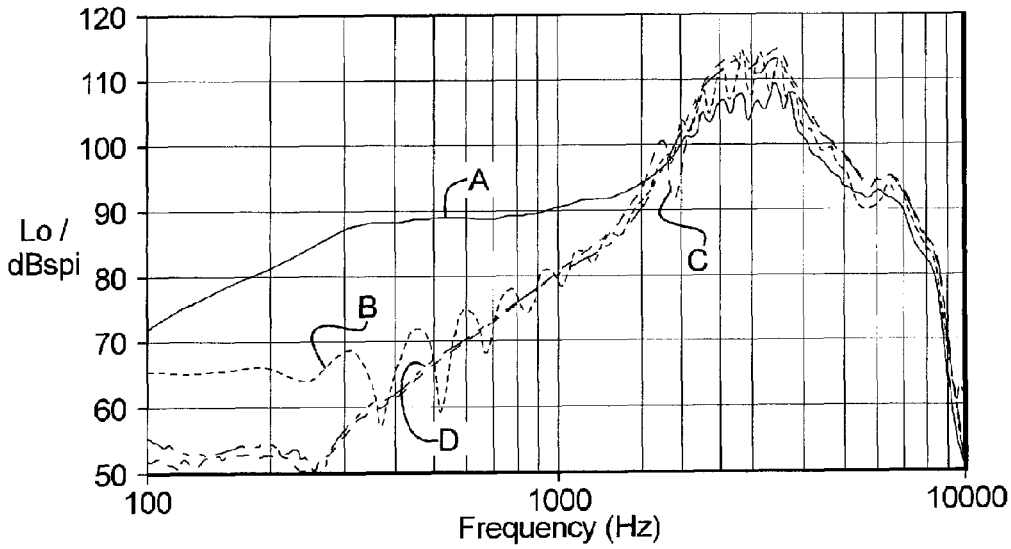
A ———— Occluded coupler in a free field
B - - - - - - - - Open fit coupler in a free field
C - - - - - - - Open fit coupler with an acoustic shield
D - - — - - — Open fit coupler with acoustic shield and sound absorption material inside the acoustic shield
Settings:
FOG - 10dB
LE65dB
Measurements at ear simulator

TEST COUPLER FOR HEARING INSTRUMENTS EMPLOYING OPEN-FIT EAR CANAL TIPS

RELATED APPLICATION

This application claims the benefit of the filing date of a provisional application titled: COUPLER FOR OPEN FITTING filed Oct. 15, 2008 and identified in the U.S. Patent Office records as Ser. No. 61/105,496, said provisional application being incorporated herein by reference.

BACKGROUND

Hearing aid measurements are performed by using a closed fitting (occluded fitting). Reference can be made to IEC 60118 series of standards or the ANSI S3.22 standard. Closed fitting means that the acoustic output of the hearing aid is sealed to the measurement coupler or ear simulator. The couplers used for hearing aid measurements are described for example in the IEC 60318 series of standards.

During the last couple of years, so called open fitted hearing aids have become very popular. Examples are: thin tube instruments with dome; or Receiver In the Canal Instruments with dome.

It is desirable to measure hearing aid performance in open fitting conditions, in which INSITU conditions are simulated as much as possible. Closed fit measurement provides a response which deviates very much from the INSITU conditions.

It has been proposed to measure in closed fitting conditions and then apply post-measurement correction curves.

The problems with non-occluded coupler measurements are for example:

a) summation of direct sound and processed sound results in an output frequency response with sharp notches (comb filter effect);
b) the sound leaking from the non-occluded coupler or ear simulator may lead to acoustic feedback which also distorts the output signal (frequency response); and
c) the summation in a) depends on the orientation and placement of the coupler and hearing aid relative to the sound source and processing delay of the circuit.

The problems have led to the conclusion that open fit measurements are not repeatable and thus not practical.

SUMMARY

It is an object to provide a system and method for open fitting hearing aid measurements that are not repeatable.

In a system or method for open fitting hearing aid frequency response sound measurements, a test space is provided having located therein a sound source, a hearing aid with a microphone, and an open fit receiver. An acoustic shield is provided and within the acoustic shield an ear simulator coupler is provided having an ear extension attached thereto, the ear extension having mounted thereto at least a portion of the open fit receiver. A measurement unit receives sound signals from the ear simulator coupler.

BRIEF DESCRIPTION OF THE DRAWINGS

FIG. 6 shows a simulated response of an RIC open fitted hearing aid system of FIGS. 1-3 subjected to open fitting hearing aid measurements; and FIG. 7 shows frequency responses of RIC open fit hearing aids obtained on an open fit coupler as shown in FIGS. 1-3.

DESCRIPTION OF THE INVENTION

Figure 1:
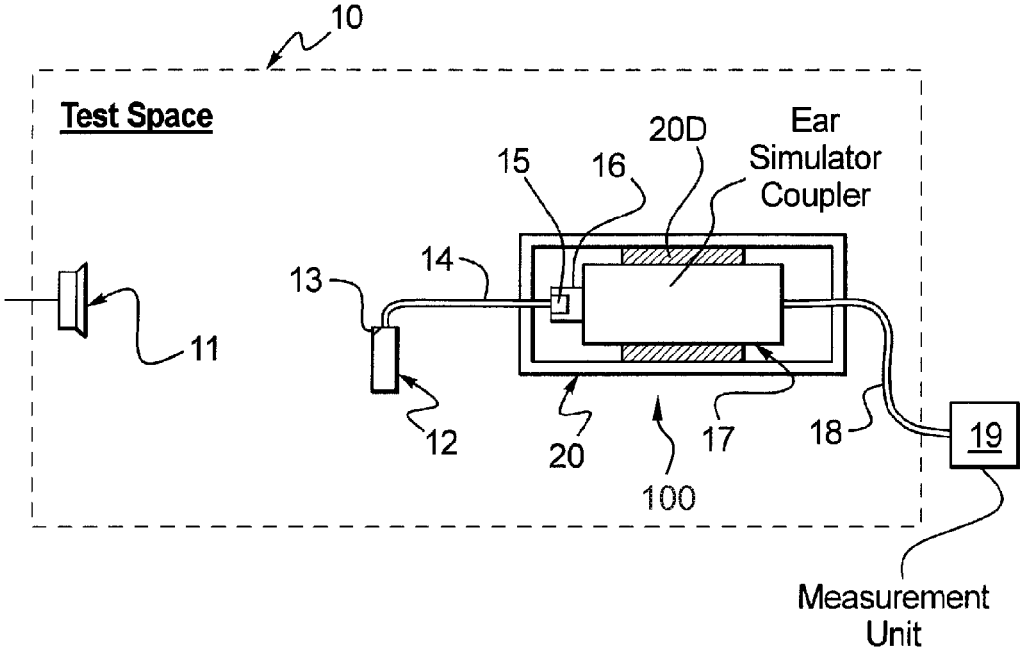
FIG. 1 shows a test setup for Receiver-In-The-Canal (RIC) open fitting hearing aid measurements.

In the RIC (Receiver-In-The-Canal) test setup of FIG. 1, an ear simulator coupler assembly 100 comprising an outer, sound-impervious acoustic shield 20 contains a standard configuration as described in coupler standards (IEC and ANSI). This shield is designed in a way that: a) the sound can leak out from the ear coupler; and b) the acoustic volume of the acoustic shield is large enough.

Figure 2:
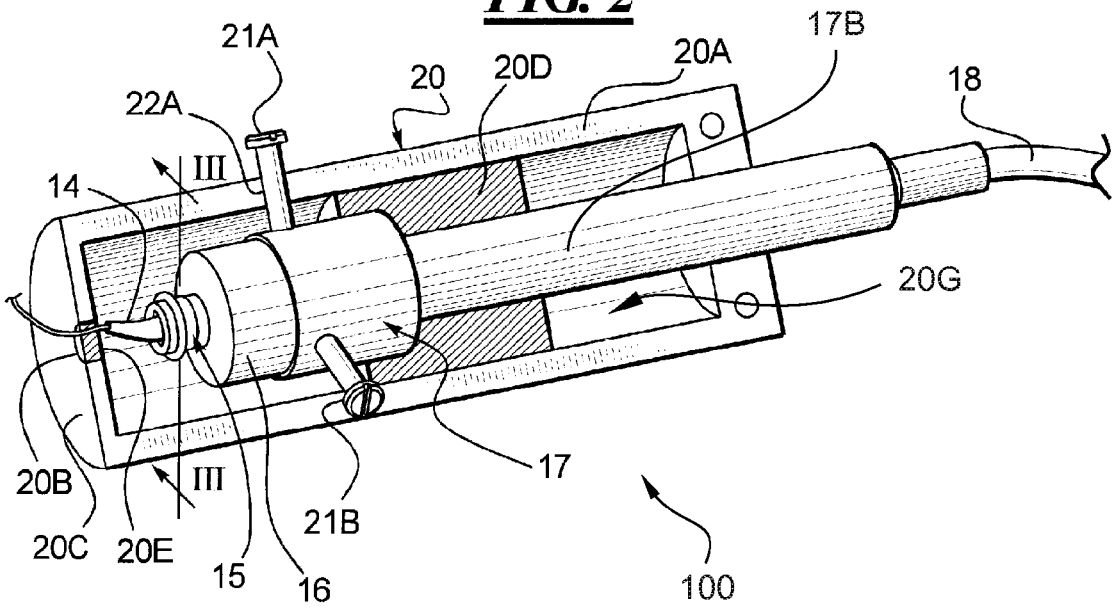
FIG. 2 illustrates in perspective view with cover removed an open fit coupler used in the RIC open fitting hearing aid measurement system.

The acoustic shield 20 may be configured in different ways. One configuration is shown in FIGS. 1 and 2. Here, the shield 20 is a closed cavity. Sound absorbing material 20D may be provided inside a portion of the length of the acoustic shield as to absorb energy to avoid resonances in the enclosure. Alternatively it can be designed as a partially—open cavity (FIG. 5) to accept a hearing instrument shell, again with sound absorbing material 20D.

As shown in FIG. 1, the test space 10 comprises a sound source 11 for generating a sound output. A hearing aid or instrument under test 12 having a hearing aid microphone 13 is connected by a cable 14 to a Receiver-In-The-Canal (RIC) open fit receiver 15 comprising a receiver element 15B with a dome tip 15A (open fit) connected thereto. The RIC open fit receiver 15 is mounted in an ear canal extension 16 releasably connected to an ear simulator coupler 17. The ear simulator coupler 17 connects via a cable 18 running from inside to outside the test space 10 to sound measurement unit 19. The An ear simulator coupler such as the Brüel & Kjær 4157, a Frye Electronics HA-1 or HA2, or a Zwislocki-type coupler may be employed.

An acoustic shield 20 surrounds the ear simulator coupler 17.

A more detailed perspective view of the ear simulator coupler 17 and acoustic shield 20 are shown in FIG. 2 but with a cover of the acoustic shield 20 removed. In FIG. 2, mounting screws 21A, B, for positioning the ear simulator coupler 17 inside the shield 20 are illustrated. One of these screws 21A is shown mounted in a threaded aperture 22A of a cylindrical sidewall 20A of the shield 20.

In FIG. 2, the ear coupler simulator assembly further comprises a preamplifier 17B (see FIG. 1 of Brüel & Kjær 4157) attached to the ear simulator coupler 17 and connected to the cable 18. The cable 14 running to the hearing aid 12 is also shown passing through aperture 20B of end 20C of shield 20. A putty seal 20E around the cable 14 closes off aperture 20B. The sound absorption material 20D can be placed inside the acoustic shield 20 between the inside wall 20G of the acoustic shield 20 and the coupler 17 to suppress acoustic resonances.

Figure 3:
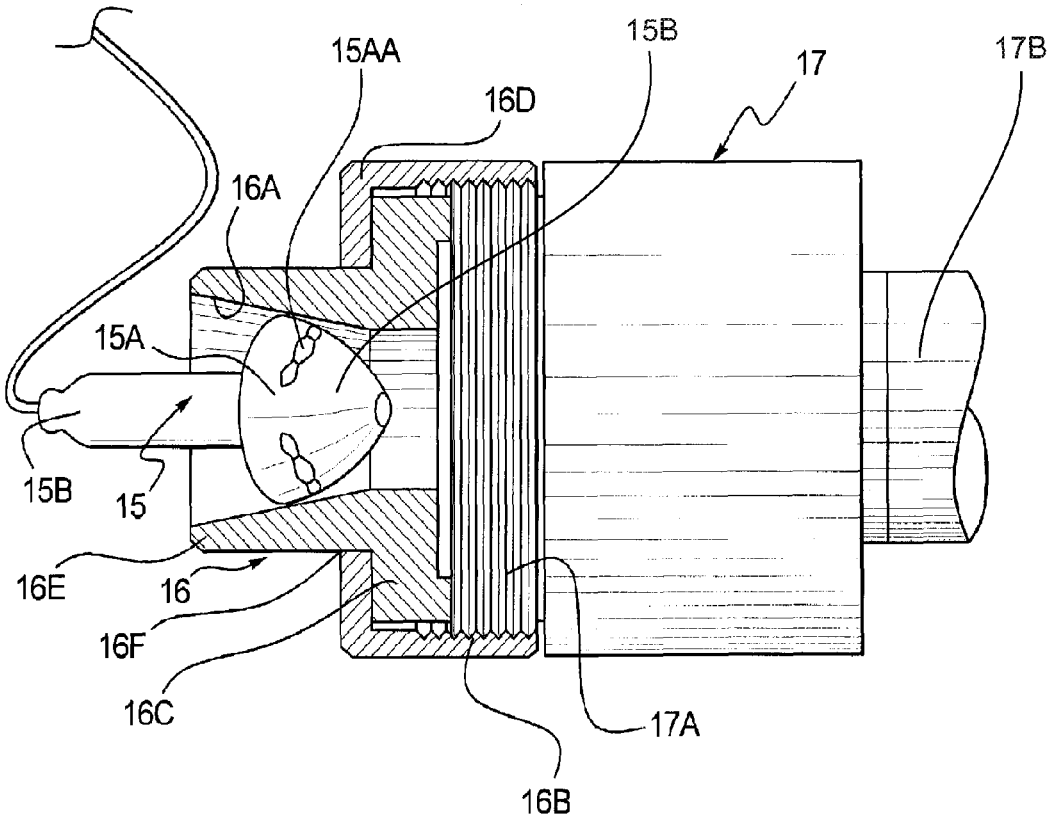
FIG. 3 illustrates a cross-sectional view taken along line III-III of FIG. 2 showing details of the ear extension and of the RIC open fit receiver.

FIG. 3 shows a cross-sectional detail of the ear canal extension 16 and open fit receiver 15 mounted therein. The RIC open fit receiver 15 comprising a receiver element 15B and a dome-shaped open-fit ear canal tip 15A comprising an outer surface 15B, the surface 15B comprising a plurality of apertures 15AA. Because sound can pass through the apertures

15AA, the ear canal tip 15A provides an "open fit" within the ear canal. An ear canal extension 16 provided with the Brüel & Kjær 4157 ear simulator coupler comprises an inner part 16C having a partial conical receptacle or opening 16A releasably receiving the outer periphery or surface 15B of the dome 15A in a press fit relationship. The inner part 16C is retained to the ear simulator coupler 17 by screw threads 16B of a retaining cap 16D engaging with screw threads 17A on the end of the ear simulator coupler 17. The inner part 16C has a cylindrical protrusion 16E passing through an aperture 16F of the cap 16D.

The RIC open fit receiver 15 shown with the dome 15A in FIGS. 1 and 3 is one possible way of realizing the open fit hearing aid. It is also possible that the receiver element is placed inside a Behind-The-Ear (BTE) hearing aid and is linked to the ear canal with a thin tube. The thin tube can also be terminated by a dome, similar to 15A. This will now be explained with reference to FIG. 4.

Figure 4:
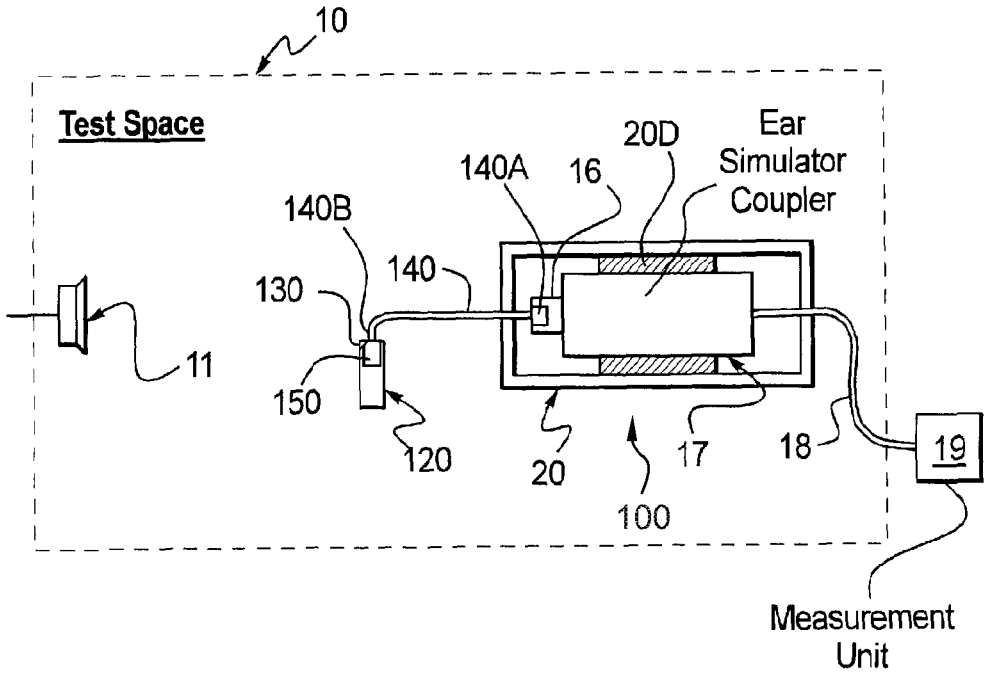
FIG. 4 shows a test setup for Behind-The-Ear (BTE) open fitting hearing aid measurements.

As shown in FIG. 4, a setup is shown for a Behind-The-Ear (BTE) hearing aid with a standard tubing or a thin tubing. Parts similar to FIG. 1 have retained the same reference numerals.

In FIG. 4, Behind-The-Ear (BTE) hearing aid 120 is provided having a microphone 130. A standard or thin tubing 140 for conveying sound waves extends at one end 140B from a receiver element 150 inside a main body of the hearing aid 120 into the simulated canal of the ear extension 16 where it terminates at an end portion 140A. The tubing end portion 140A may be connected to and suspended by a dome similar to 15A as shown in FIG. 3. The tubing 140 and tubing end portion 140A (which may also include the dome 15A) together with the receiver element 150 functions as, and thus forms, the BTE open fit receiver.

Figure 5:
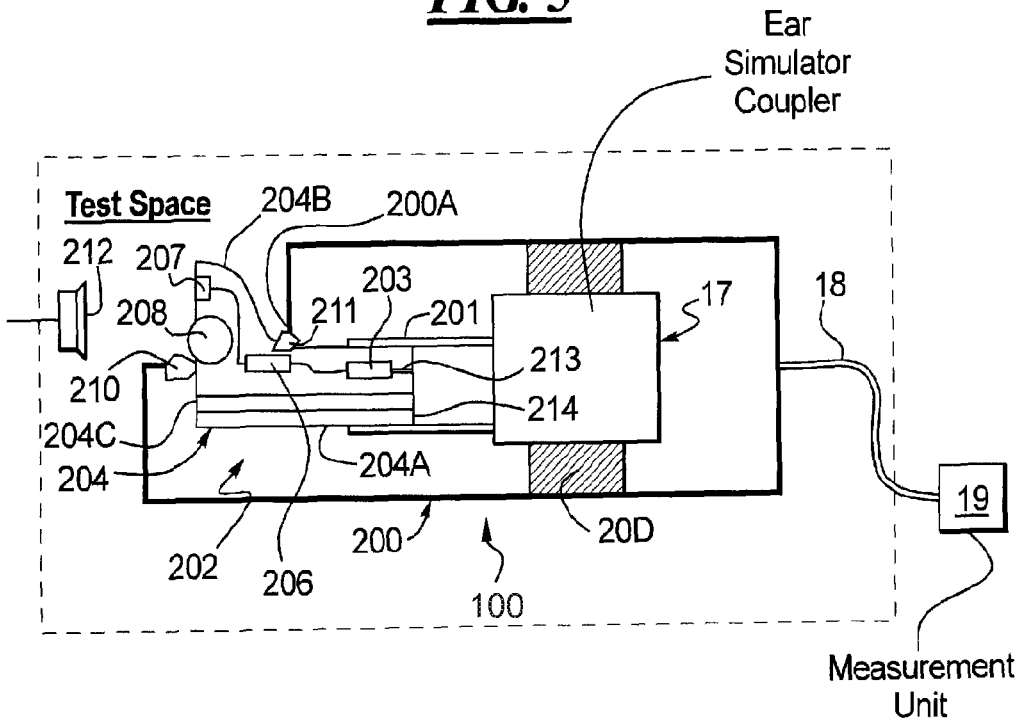
FIG. 5 shows a test setup for In-The-Ear (ITE) open fitting hearing aid measurements.

Alternatively, in FIG. 5, a setup for an In-The-Ear (ITE) hearing aid with venting is shown. Here an acoustic shield 200 surrounds the ear simulator coupler 17 located therein. A sound absorbing or damping material 20D is provided between a portion of the length of the acoustic shield 200 and the ear simulator coupler 17. The measurement unit 19 connects through the cable 18 with the ear simulator coupler 17. At the input side, an ear canal extension 201 is provided, such as an open ended cylinder. The ear canal extension 201 receives at its open end an ITE hearing aid 202 with venting having an ITE open fit receiver element 203 located at a sound conveying channel 213 and supported in a cylindrical hearing aid body portion 204A of an overall hearing aid body or shell 204. The cylindrical portion 204A followed by an enlarged portion 204B of the body 204. The body 204 also houses an amplifier 206 connected to the output of a hearing aid microphone 207 and the receiver 203. A battery 208 is also provided in the enlarged portion 204B of the body 204.

Significantly a vent passage 204C passes through the body 204; thus the receiver element 203, the channel 213, and the vent passage 204C functioning together form the open fit receiver.

A putty seal 210 and another putty seal 211 close off an aperture 200A of the acoustic shield 200 where the enlarged portion 204B of the body 204 passes through so that the hearing aid microphone 207 is external to the acoustic shield 20. The sound source 212 sends sound waves for testing to the hearing aid microphone 207. The acoustic shield 200 with the ear simulator coupler 17 therein is provided within the test space 10 along with the hearing aid sound source 212.

FIG. 6 shows a simulated response of the RIC open fit hearing aid instrument obtained with a conventional (or unshielded) setup (original-solid line marked B) and with the devices described here (coupler enclosed in the acoustic shield —dashed line A).

FIG. 7 shows the open fit coupler frequency response curves (RIC dome open-coupler installed) for: A—occluded coupler in a free field; B—open fit coupler in a free field; C—open fit coupler with an acoustic shield; and D—open fit coupler with acoustic shield and sound absorption material inside the acoustic shield.

Advantages of the configurations shown above are as follows:

a) no summation of direct and processed sound, since the direct sound cannot leak through the open fit ear mold (dome) into the coupler;

b) sound leaking from the open fit mold cannot reach the hearing aid microphone, thus eliminating feedback; and c) alignment of the coupler relative to the hearing aid and sound source and the processing delay of the circuit are no longer critical.

We claim:

1. A system for measuring the frequency response of a hearing instrument employing an open-fit ear canal tip, comprising:

a hearing instrument under test comprising a microphone for receiving the sound test signal from a sound source; and an an open-fit ear canal tip for conveying sound generated by the hearing instrument under test;

a sound source for generating a sound test signal for receipt by the microphone of the hearing instrument under test;

an ear simulator coupler assembly comprising an outer, sound-impervious acoustic shield;

an ear simulator coupler within the acoustic shield, releasably receiving an ear canal extension and comprising an output for connection to a measurement device;

an ear canal extension, within the acoustic shield and attached to the ear simulator coupler, the ear canal extension releasably receiving the hearing instrument open-fit ear canal tip; and a measurement unit receiving the output from the ear simulator coupler.

2. A system of claim 1 wherein said acoustic shield is cylindrical.

3. A system as set forth in claim 1 where the ear canal extension comprises a conical receptacle for receiving the ear canal tip.

4. A system as forth in claim 1 where the acoustic shield comprises an inside wall and further comprising sound absorbing material between the ear simulator coupler and a portion of the length of the inside wall of the acoustic shield.

5. A system as set forth in claims 1 where the open-fit ear canal tip comprises a dome comprising an at least one vent and an outer surface that releasably mates with the ear canal extension.

6. A system as set forth in claim 1 the outer shield of the ear simulator coupler assembly comprising an aperture for receiving the shell of an in-the-ear hearing instrument.

7. A system as set forth in claim 6 where the ear canal extension further comprises a cylindrical section for receiving the hearing instrument shell.

* * * * *